US007864925B2

(12) United States Patent
Kutschera

(10) Patent No.: US 7,864,925 B2
(45) Date of Patent: Jan. 4, 2011

(54) CATHODE

(75) Inventor: Wolfgang Kutschera, Aurachtal (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/394,780

(22) Filed: Feb. 27, 2009

(65) Prior Publication Data

US 2009/0220051 A1 Sep. 3, 2009

(30) Foreign Application Priority Data

Feb. 29, 2008 (DE) ..... 10 2008 011 841

(51) Int. Cl.
*H01J 35/06* (2006.01)

(52) U.S. Cl. ..... 378/136; 313/348

(58) Field of Classification Search ..... 378/136; 313/293, 295, 296, 304, 348, 447
See application file for complete search history.

(56) References Cited

U.S. PATENT DOCUMENTS

| | | | | |
|---|---|---|---|---|
| 3,934,168 | A * | 1/1976 | Hardman et al. | 313/293 |
| 4,593,230 | A * | 6/1986 | True | 313/349 |
| 2007/0246789 | A1 | 10/2007 | Freudenberger et al. | |

FOREIGN PATENT DOCUMENTS

| | | | |
|---|---|---|---|
| DE | 27 27 907 | C2 | 1/1979 |
| DE | 199 14 739 | C1 | 8/2000 |
| DE | 199 55 845 | A1 | 5/2001 |

* cited by examiner

*Primary Examiner*—Chih-Cheng G Kao
(74) *Attorney, Agent, or Firm*—Schiff Hardin LLP

(57) ABSTRACT

A cathode has a cathode head in which is arranged a surface emitter is arranged that emits electrons upon the application of a heating voltage. At least one electrically conductive barrier plate that is galvanically separated from the surface emitter extends up to the surface emitter. This cathode has a longer lifespan, a high electron emission and a good blocking capability.

4 Claims, 1 Drawing Sheet

CATHODE

BACKGROUND OF THE INVENTION

1. Field of the Invention

The invention concerns a cathode.

2. Description of the Prior Art

Cathodes that have a spiral emitter (spiral-wound filament) or surface emitter are used in x-ray tubes, for example. A cathode with a spiral emitter is known from DE 199 55 845 A1, for example. Cathodes that have surface emitters are described in DE 27 27 907 C2 and in DE 199 14 739 C1, for example.

In operation of the x-ray tube, heating voltage is applied to the spiral emitter or to the surface emitter, causing electrons to be emitted that are accelerated in the direction of an anode. X-ray radiation is generated in the surface of the anode upon the electrons striking the anode.

The high temperature of the spiral-wound filament produces a vaporization of the material (tungsten), and a slow thinning of the spiral filament results from this that ultimately leads to a fracture of the spiral filament. This effect is generally known in filament lamps.

A reduction of the wear, and an associated increase of the lifespan can be achieved only by a reduction of the operating temperature of the spiral emitter, but this leads to an unwanted reduction of the electron emission. In order to prevent a reduction of the electron emission due to reduced operating temperature of the spiral emitter, a particularly simple measure that lends itself to the situation is to make the radiating surface for the electron emission comparably large without having to use significantly higher heating currents. Given a suitable design, such a surface emitter has a distinctly larger radiating surface usable for emission relative to the volume to be heated and in comparison to a spiral emitter.

In spite of the greater lifespan of a surface emitter, as before spiral transmitters are nevertheless used since, among other things, surface emitters can be most difficult to block via electrical fields due to their larger radiating surface (emission surface). This blocking by application of a negative voltage at the cathode head is necessary in many applications, in particular given application with pulsed x-ray radiation. Particularly the more central regions of large-area surface emitters are geometrically further removed from the electron accumulations generating the barrier field at the cathode head, and thus can be blocked only by higher electron concentrations or, respectively, higher field strengths. Higher field strengths in turn entail greater minimum distances to be maintained (to avoid flash-overs) as well as additional construction expenditure.

SUMMARY OF THE INVENTION

An object of the present invention is to provide a cathode with a high electron emission and a greater lifespan as well as a good blocking capability.

This object is achieved according to the invention by a cathode having a cathode head in which a surface emitter is arranged that emits electrons upon application of a heating voltage. According to the invention, at least one electrically conductive barrier plate that is galvanically separated from the surface emitter extends up to the surface emitter.

In accordance with the invention, the barrier plate can lie at a cathode head potential, for example, but this does not necessarily have to be the case. It is also possible for the barrier plate to be galvanically separated both from the surface emitter and from the cathode head and lies at a different potential than the cathode head.

The disadvantage of a poorer blocking capability, or a blocking capability that can be achieved only with a higher barrier voltage, is remedied by the inventive measure of at least one electrically conductive barrier plate that is galvanically separated from the surface emitter, extending to the surface emitter. The cathode according to the invention thus can also be used for applications in which a fast blocking capability of the electron emission is required. In spite of the fast blocking capability, the cathode according to the invention also exhibits a long lifespan.

Higher field strengths for fast blocking of the surface emitter that require greater minimum distances to be maintained to avoid flash-overs, as well as additional design measures, are therefore not necessary in the cathode according to the invention.

The solution according to the invention can be realized in cathodes with geometrically different surface emitters.

For example, in the rectangular surface emitter known from DE 27 27 907 C2, which surface emitter has recesses that are alternately arranged from two opposite sides and transversal to the longitudinal direction, at least one barrier plate can extend into at least one of the recesses.

In the surface emitter described in DE 199 13 739 C1, which surface emitter possesses a circular footprint and is subdivided into conductor traces running in a spiral shape that are separated from one another by wandering recesses, at least one barrier plate can extend into at least one of the recesses.

An embodiment in which at least one barrier plate exhibits the shape of a tongue is particularly advantageous since in this case the barrier plate can be adapted to the appertaining surface emitter in a manner that is particularly simple in terms of design and manufacture. This embodiment of the cathode according to the invention is in particular particularly advantageous for an embodiment in which at least one barrier plate extends into at least one of the recesses. However, in the scope of the invention the barrier plate can also be brought up to the surface emitter in a different manner.

DESCRIPTION OF THE PREFERRED EMBODIMENTS

Figure 1:
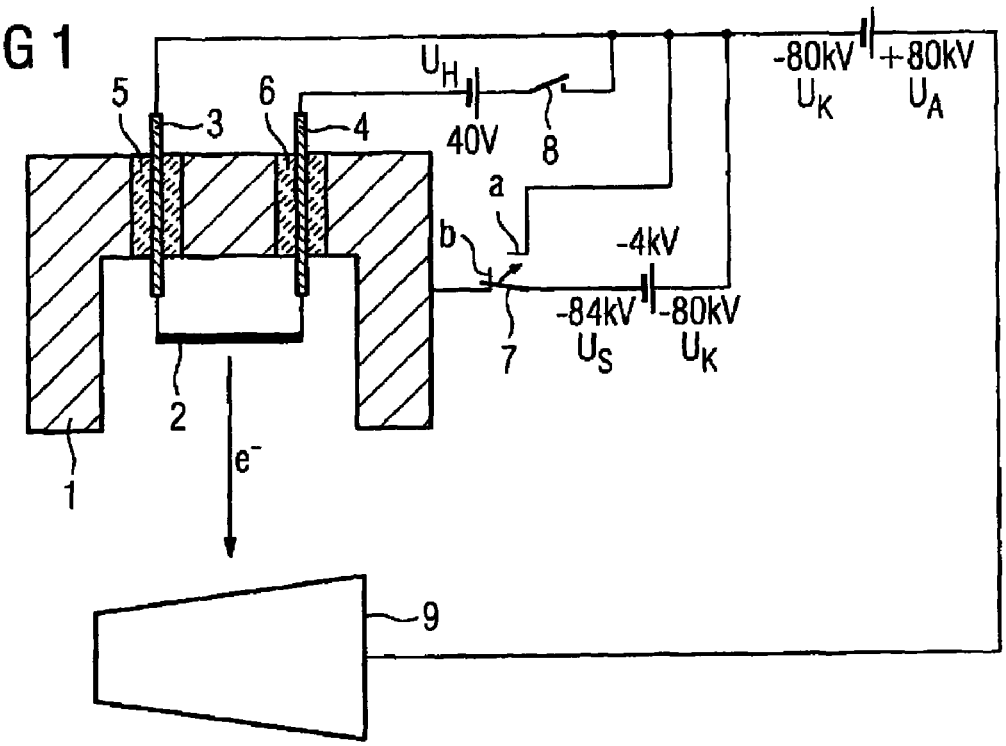
FIG. 1 is a representation of a cathode.

The cathode shown in FIG. 1 has a cathode head 1 in which is arranged a surface emitter 2.

The cathode shown in FIG. 1 comprises a cathode head 1 in which is arranged a surface emitter 2.

The surface emitter 2 is set at an operating voltage $U_K$ of −80 kV atop contact pins 3 and 4 that are held insulated in the cathode head 1 via ceramic feedthroughs 5 and 6.

Furthermore, the cathode head 1 can be selectively switched to the operating voltage $U_K$ of −80 kV or to a voltage $U_S$ of −84 kV via a switching element 7. If the switching element 7 is located in the switch position a, the operating voltage $U_K$ of −80 kV is present at the cathode head 1. In the switch position b of the switching element 7, the voltage $U_S$ of −84 kV is present at the cathode head 1, thus 4 kV more than at the surface emitter 2. A barrier voltage of 4 kV is thus present.

The contact pin 4 can additionally be switched to a heating voltage $U_H$ via a switching element 8.

If the cathode head 1 and the surface emitter 2 lie at an operating voltage $U_K$ of −80 kV (switch position a) and heating voltage $U_H$ of 40 V is applied at the surface emitter 2 (switching element 8 is closed), electrons (designated with $e^-$ in FIG. 1) are then emitted from the surface emitter 2 and accelerated in the direction of an anode 9 that lies at an anode potential $U_A$ of +80 kV. Upon the electrons striking the anode 9, x-rays are generated in this in a known manner.

To block the electron emission, the switching element 7 is switched into its switch position b so that the cathode head 1 lies at a voltage $U_S$ of −84 kV, i.e. 4 kV more negative than the surface emitter 2. This voltage of 4 kV is designated as a barrier voltage. Electrons being negatively charged, thus cannot escape from the cathode head (same effect as a barrier grid).

If a surface emitter 2 according to the prior art (FIG. 2) is used in the cathode according to FIG. 1, the electron flow (designated again with $e^{-1}$ in FIG. 2) in such a cathode can be blocked only with relatively high field strengths since the more central regions of the emission surface of the surface emitter 2 are relatively far removed from the cathode head 1.

Figure 2:
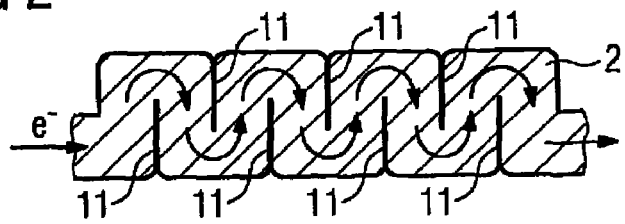
FIG. 2 is a plan view of a surface emitter according to the prior art.

The surface emitter according to FIG. 2 has recesses 11 that are alternatively arranged from two opposite sides and transversal to the longitudinal direction.

The disadvantage of a poorer blocking capability of the electron flow (likewise designated with $e^-$ in FIG. 3), or a blocking capability that can only be achieved with a higher barrier voltage, is remedied by the solution according to the invention to move at least one electrically conductive barrier plate 10 (which is galvanically separated from the surface emitter 2) up to the surface emitter 2 so that at no point of the surface emitter 2 does too great a distance from the barrier potential occur.

Figure 3:
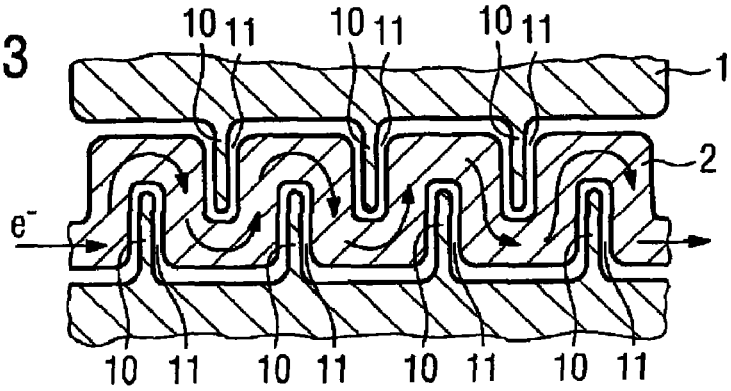
FIG. 3 is a plan view of a surface emitter as it is present in an embodiment of a cathode according to the invention.

In the exemplary embodiment shown in FIG. 3, the barrier plates 10 that are connected in an electrically conductive manner with the cathode head 1 (and therefore lie at the cathode head potential) respectively exhibit the shape of a tongue and extend into the recesses 11 that are alternatively arranged from two opposite sides and transversal to the longitudinal direction of the surface emitter 2.

In the embodiment of the surface emitter 2 that is presented in FIG. 3, the barrier plates 10 therefore come particularly close to the more central regions of the emission surface of the surface emitter 2. Higher field strengths for fast blocking of the surface emitter 2 that require larger minimum distances to be maintained to avoid flash-overs, as well as additional design measures, are therefore not necessary given a cathode with a surface emitter according to FIG. 3.

A cathode with a surface emitter 2 designed according to FIG. 3 is thus particularly well suited for applications in which a fast blocking capability of the electron emission that is comparable to a spiral emitter is desired or required (for example given applications with pulsed x-ray radiation), and a longer lifespan of the surface emitter 2 (and therefore of the cathode) is simultaneously achieved.

Although modifications and changes may be suggested by those skilled in the art, it is the intention of the inventor to embody within the patent warranted hereon all changes and modifications as reasonably and properly come within the scope of his contribution to the art.

I claim as my invention:

1. A cathode comprising:

a cathode head comprising a surface emitter that emits electrons upon application of a heating voltage thereto;

said cathode head further comprising at least one electrically conductive barrier plate that is galvanically separated from said surface emitter and that extends up to said surface emitter; and said surface emitter comprising recesses that alternate from two opposite sides of said surface emitter and that extend transversely to a longitudinal direction of said surface emitter, and wherein said at least one barrier plate extends into at least one of said recesses.

2. A cathode as claimed in claim 1 wherein said at least one barrier plate has a tongue-like shape.

3. A cathode comprising:

a cathode head comprising a surface emitter that emits electrons upon application of a heating voltage thereto;

said cathode head further comprising at least one electrically conductive barrier plate that is galvanically separated from said surface emitter and that extends up to said surface emitter; and said surface emitter comprising conductor traces that subdivide said surface emitter, said conductor traces proceeding in a spiral configuration and being spaced from each other by respective recesses, and wherein said at least one barrier plate extends into at least one of said recesses.

4. A cathode as claimed in claim 3 wherein said at least one barrier plate has a tongue-like shape.

* * * * *